US010487448B2

(12) United States Patent
Gallet et al.

(10) Patent No.: US 10,487,448 B2
(45) Date of Patent: Nov. 26, 2019

(54) STEEL CORD WITH REDUCED RESIDUAL TORSIONS

(71) Applicant: NV BEKAERT SA, Zwevegem (BE)

(72) Inventors: Jan Gallet, Humbeek (BE); Rik Mullebrouck, Wevelgem (BE); Ghislain Doornaert, OSA Peninsula (CR)

(73) Assignee: NV BEKAERT SA, Zwevegem (BE)

( * ) Notice: Subject to any disclaimer, the term of this patent is extended or adjusted under 35 U.S.C. 154(b) by 480 days.

(21) Appl. No.: 15/308,304

(22) PCT Filed: Apr. 7, 2015

(86) PCT No.: PCT/EP2015/057490
§ 371 (c)(1),
(2) Date: Nov. 1, 2016

(87) PCT Pub. No.: WO2015/169521
PCT Pub. Date: Nov. 12, 2015

(65) Prior Publication Data

US 2017/0073888 A1 Mar. 16, 2017

(30) Foreign Application Priority Data

May 8, 2014 (EP) ..... 14167476

(51) Int. Cl.
*D07B 1/06* (2006.01)
*D07B 5/12* (2006.01)
*D07B 7/02* (2006.01)

(52) U.S. Cl.
CPC ..... *D07B 1/062* (2013.01); *D07B 5/12* (2013.01); *D07B 7/022* (2013.01); *D07B 1/0626* (2013.01);
(Continued)

(58) Field of Classification Search
CPC ..... D07B 1/062; D07B 5/12; D07B 7/022
See application file for complete search history.

(56) References Cited

U.S. PATENT DOCUMENTS 1,960,426 A * 5/1934 Zundorf ..... D07B 5/12 140/147
3,771,304 A 11/1973 Taketomi et al.
(Continued)

FOREIGN PATENT DOCUMENTS

EP 0466720 B1 11/1993
EP 0635597 A1 1/1995
(Continued)

OTHER PUBLICATIONS

International Search Report (ISR) dated Jun. 25, 2016, for PCT/EP2015/057490.

*Primary Examiner* — Shaun R Hurley
(74) *Attorney, Agent, or Firm* — Bacon & Thomas, PLLC

(57) ABSTRACT

A steel cord for reinforcing a breaker or belt ply in a rubber tire having a core group and a sheath group. The core group consists of two to four core steel filaments with a first diameter dc and the sheath group consists of one to six sheath steel filaments with a second diameter ds. The ratio dc/ds of the first diameter dc to the second diameter ds ranges from 1.10 to 1.70. The two core steel filaments are untwisted or have a twisting step greater than 300 mm. The sheath group is twisted around the core group with a cord twisting step in a cord twisting direction. The ratio of the difference in residual torsions of the core group and the sheath group to the difference in saturation level between the core group and the sheath group ranges from 0.10 to 0.65, preferably from 0.10 to 0.60.

11 Claims, 5 Drawing Sheets

(52) U.S. Cl.
CPC ..... *D07B 2201/206* (2013.01); *D07B 2201/2006* (2013.01); *D07B 2201/2011* (2013.01); *D07B 2201/2023* (2013.01); *D07B 2201/2029* (2013.01); *D07B 2201/2039* (2013.01); *D07B 2201/2051* (2013.01); *D07B 2205/3035* (2013.01); *D07B 2205/3053* (2013.01); *D07B 2205/3089* (2013.01); *D07B 2207/208* (2013.01); *D07B 2207/4072* (2013.01); *D07B 2401/2015* (2013.01); *D07B 2501/2046* (2013.01)

(56) References Cited

U.S. PATENT DOCUMENTS 4,408,444 A 10/1983 Baillievier
5,285,623 A * 2/1994 Baillievier ..... D07B 1/062 152/451
5,487,262 A 1/1996 De Waegenaere et al.
5,512,380 A * 4/1996 De Vos ..... D07B 1/062 152/451
5,581,990 A * 12/1996 Van Giel ..... D07B 1/0653 57/13
5,743,078 A * 4/1998 Doornaert ..... D07B 1/062 57/212
6,365,273 B1 * 4/2002 Baillievier ..... D07B 1/062 428/364
2003/0188525 A1 * 10/2003 Kobayashi ..... D07B 1/0613 57/212
2010/0005774 A1 * 1/2010 Fukuda ..... D07B 1/062 57/212
2010/0200143 A1 * 8/2010 Okamoto ..... B29D 30/48 152/539
2011/0268954 A1 * 11/2011 Qi ..... D07B 1/062 428/222

FOREIGN PATENT DOCUMENTS

EP 2060673 A1 5/2009
EP 2689939 A1 1/2014
JP H04-266441 A 9/1992
JP H06-306784 A 11/1994
JP 2008025040 A 2/2008
JP 2013199189 A 10/2013
JP 2013199190 A 10/2013
JP 2013199191 A 10/2013
JP 2013199193 A 10/2013
JP 2013199194 A 10/2013
JP 2013199195 A 10/2013
JP 2013199717 A 10/2013
WO 2012/128372 A1 9/2012

* cited by examiner

STEEL CORD WITH REDUCED RESIDUAL TORSIONS

The invention relates to a steel cord adapted to reinforce a breaker or belt ply in a rubber tire. The invention also relates to a twisting equipment and to a method to make such a steel cord.

BACKGROUND ART

Steel cords for reinforcing breaker or belt plies in a rubber tire are well known in the art.

U.S. Pat. No. 4,408,444 discloses a M+N construction, and more particularly a 2+2 construction. This cord has two groups of filaments, a first group with M, preferably two filaments and a second group with N, preferably two filaments. This cord, at least in its 2+2 embodiment, has the advantage of full rubber penetration whether brought under tension or not. However, this cord construction suffers from the drawback of having a relatively poor fatigue limit and too great a cord diameter.

In an attempt to mitigate these drawbacks, EP-B1-0 466 720 proposes a similar but different M+N construction. The difference is that the filaments of one group have a filament diameter which differs from the filaments of the other group. The result is an increase in fatigue limit and, sometimes, a decrease in cord diameter for the same reinforcing effect.

M+N constructions with difference in filament diameters are, however, difficult to process during tire manufacturing, particularly in an automated system. Filaments with a difference in diameter have different saturation levels of residual torsions. The resulting cords are subject to flare. The cords are less stable and the integration of such cords in rubber plies leads to tip rise of the rubber plies, i.e. one or more edges are lifting up.

When applying torsions to a steel cord or a steel filament, the first observed phenomenon is linear, i.e. the number of residual torsions is equal to the number of applied torsions. Further increasing the number of applied torsions leads to an increase of residual torsions but not to the same degree: in decreasing amounts. In other words, a saturation phenomenon is observed. As soon as there is no increase anymore of residual torsions, the saturation level of residual torsions has been reached.

The saturation level of residual torsions of a steel filament is dependent upon the material of the steel filament, the tensile strength of the steel filament and, especially, upon the diameter of the steel filament.

In order to cope with the problem of tip rise, WO-A1-2012/128372 proposes a $2xd_c+Nxd_s$ construction where the filament diameter of the core group $d_c$ is greater than the filament diameter of the sheath group $d_s$ and where the two core filaments are plastically deformed to such a degree that they form a wave with such an amplitude that the core steel filaments get well anchored by the rubber in the ultimate rubber ply. This anchorage hinders any negative effect of residual torsions and lowers the tip rise of any reinforced rubber ply.

However, the $2xd_c+Nxd_s$ of WO-A1-2012/128372 suffers from flare and risks to become a less robust or less stable construction.

The term 'flare' refers to the phenomenon of spreading of the filaments ends or the strand ends after cutting of the steel cord or steel strand. A steel cord without flare does not exhibit this spreading, the filaments or strands remain more or less in their position after cutting.

Patent applications JP-A-2013199194, JP-A-2013199193, JP-A-2013199191, JP-A-2013199717, JP-A-2013199195, JP-A-2013199190, JP-A-2013199189 all disclose $2xd_c+Nxd_s$ steel cord constructions but they do not offer a solution of the problem of flare and neither a solution for the too great a wave of the core steel filaments.

JP-A-06-306784 discloses a way of manufacturing a 2 (core)+2 (sheath) steel cord construction by means of a double-twister where used is made of a turbine or false twister. The core steel filaments and the sheath steel filaments have the same diameter.

U.S. Pat. No. 5,487,262 discloses a method and device for making a steel cord where use is made of two false twisters in sequence.

SUMMARY OF THE INVENTION

A general object of the invention is to avoid the drawbacks of the prior art.

A particular object of the invention is to provide a steel cord without flare.

Another object of the invention is to provide a steel cord with reduced plastic deformation.

Yet another object of the invention is to provide a steel cord with an improved robustness.

Still another object of the invention is to keep the tip rise of a rubber ply reinforced with a steel cord according to the invention low or zero.

According to a first aspect of the invention there is provided a steel cord adapted to reinforce a breaker or belt ply in a rubber tire.

The terms "adapted to reinforce a breaker or belt ply in a rubber tire" refer to steel cords where the steel filaments are made from a plain carbon steel (see example hereafter), have a filament diameter ranging from 0.10 mm to 0.40 mm, e.g. ranging from 0.12 mm to 0.35 mm, have a sufficient tensile strength (tensile strength $R_m$ ranging from 1500 MPa to 4000 MPa and higher) and are provided with a coating promoting adhesion with rubber such as a binary brass coating or a ternary zinc-cobalt-copper or zinc-copper-nickel coating.

The steel cord comprises a core group and a sheath group. Preferably the steel cord only consists of a core group and a sheath group.

The core group has two to four core steel filaments with a first diameter $d_c$, for example two core steel filaments with a diameter $d_c$. Preferably the core steel filaments have about the same tensile strength and the same steel composition.

The sheath group has one to six sheath steel filaments with a second diameter $d_s$, for example two to four sheath filaments with a second diameter $d_s$. Preferably the sheath steel filaments have about the same tensile strength and the same steel composition.

The first diameter $d_c$ is greater than the second diameter $d_s$. Preferably the diameter ratio $d_c/d_s$ ranges from 1.10 to 1.70, preferably from 1.10 to 1.50. The two to four core steel filaments are untwisted or have a twisting step greater than 300 mm. The sheath group and the core group are twisted around each other with a cord twisting step in a cord twisting direction.

The ratio of the absolute value of the difference in residual torsions of the core group and the sheath group to the absolute value of the difference in saturation level between the core group and the sheath group ranges from 0.15 to 0.65, preferably from 0.15 to 0.60, for example from 0.15 to 0.55, for example from 0.25 to 0.50. This is valid in case the total cord has no residual torsions.

The saturation level is expressed in number of revolutions per meter.

The amount of residual torsions is also expressed in number of revolutions per meter.

The residual torsions of a steel cord or of a steel filament are determined as follows: One end of the steel cord or steel filament of a particular length is allowed to turn freely, the other end is hold fixed. The number or revolutions is counted and their direction is noted.

The way how residual torsions of a core group or of a sheath group are determined will be explained hereinafter.

The saturation level of a steel filament is the maximum number of elastic torsions (expressed as number of revolutions per meter) one can apply to a steel filament. The saturation level of a group of equal steel filaments, i.e. equal diameter, composition and tensile strength, is equal to the saturation level of an individual steel filament of that group. In practice, the saturation level is determined or measured before the twisting process.

For applied torsions in the S-direction, residual torsions which make the twisting step or twist pitch shorter have a positive sign, residual torsions which make the twisting step or twist pitch longer have a negative sign. For applied torsions in the Z-direction, the opposite is valid.

The invention is particularly suited for steel cord constructions made by means of a double twister since with a double twister the individual steel filaments may be subjected to a twist on themselves, which is not the case with steel cords made by means of a tubular strander in the normal way. In the present invention, the sheath steel filaments are preferably twisted on themselves. This individual twisting of the steel filaments, next to the twisting of groups and cord, may increase the amount of residual torsions of the sheath group.

The characterizing feature of a steel cord according to the invention can be written in following formula:

$$0.10 \leq \rho = |RTc - RTs| / |SLc - SLs| \leq 0.65$$

The ratio ρ is the ratio of the torsion gap as measured to the (maximum) torsion gap which could be obtained in case a double false twister would not be used. Due to the use of a double false twister the ratio ρ can be kept between the mentioned limits. This reduced level of difference in residual torsions between the core group and the sheath group contributes to a more robust steel cord with reduced or even total avoidance of flare and without the necessity of high levels of plastic deformation and great amplitudes of waves of the steel core filaments. Due to the reduced level of difference in residual torsions, the need for anchorage of the core filaments in the rubber ply is less prominent.

There is no need to bring the residual torsions of the core group and/or the sheath group individually or separately to zero in order to reach the advantages of absence of flare and increase in robustness. On the contrary bringing the residual torsions to zero would require too much energy in the twisting process.

According to another preferable embodiment, the amount of residual torsions of the core group is substantially different from the amount of residual torsions of the sheath group.

According to a preferable embodiment, the one to six sheath steel filaments of the steel cord of the invention are twisted around each other with a cord twisting step and in a cord twisting direction.

A preferable cord construction according to the first aspect of the invention has a core group with two core steel filaments and a sheath group with three sheath steel filaments. So a preferable cord construction is $2xd_c+3xd_s$.

As mentioned, due to the low levels of residual torsions in both the core steel filaments and the sheath steel filaments, the plastic deformation of the individual steel filaments may be reduced.

As a result of such a reduced plastic deformation, each of the core steel filaments may have a wave height $h_c$ ranging from $2.2xd_c$ to $2.7xd_c$.

Similarly, each of the sheath filaments may have a wave height $h_s$ ranging from $2.2xd_s$ to $3.9xd_s$.

Due to the reduced plastic deformation of the individual steel filaments, the linear density of the resulting invention cord is also reduced, e.g. by more than one percent. Eventually this leads to a reinforced rubber ply and tire with a reduced weight.

Preferably the steel cord according to the first aspect of the invention has no flare.

Also preferably the steel cord has a tensile strength exceeding 2500 MPa, e.g. exceeding 2700 MPa.

The steel cord preferably has a breaking load exceeding 450 Newton, e.g. exceeding 500 Newton.

According a second aspect of the invention, there is provided a rubber ply comprising a plurality of steel cords according to the first aspect of the invention. The steel cords are arranged in parallel next to each other with a density ranging from 6 ends per cm to 12 ends per cm, e.g. from 6.5 ends per cm to 11 ends per cm. The thickness of the rubber ply ranges from 0.65 mm to 1.6 mm, e.g. from 0.7 mm to 1.5 mm and is e.g. 1.2 mm. The rubber ply has a tip rise lower than 10 mm, e.g. lower than 5 mm. This reduction in tip rise facilitates the automated processing of the rubber plies in the manufacturing of tires.

Before integrating into the belt or breaker of a tyre, rubber reinforced by steel cords is cut into a ply with the form of a parallelogram, i.e. with two sharp angles and two obtuse angles. The tip rise is the phenomenon that the sharp angle of the ply may show a rise, i.e a distance to the base. The tip rise is the vertical distance in mm between a base and a sharp angle of the ply. The amount of tip rise is mainly due to the residual torsions of the individual cords. As the tip rise only concerns one corner of the ply, its amount is independent of the length and width of the rubber ply.

According to a third aspect of the present invention, there is provided equipment for manufacturing an m+n cord according to the first aspect of the invention. This equipment comprises a double-twister and supply spools positioned at a first side of the double-twister for supplying the two to four core steel filaments to the double-twister.

In case of less supply spools than the number of core filaments, some core filaments are multiple wound in parallel on the spool.

The double-twister comprises a stationary cradle. The cradle bears supply spools for supplying one to six sheath steel filaments to an assembly point inside the double-twister.

As is the case with the number of supply spools outside the double twister, there can also be less supply spools than the number of sheath filaments, namely when multiple winding has been applied.

The equipment further comprises a cord spool for receiving a twisted steel cord leaving the double-twister. This cord spool is positioned at a second side of the double-twister, preferably opposite to the first side.

The equipment further comprises a first false twister and a second false twister. The first false twister and the second false twister are both positioned between the double-twister and the cord spool.

It is due to the second false twister which rotates in a direction opposite to the first false twister, that the level of the residual torsions of both the core group and the sheath group is brought to an acceptable low level.

The terms "false twister" refer to a device that applies a number of twists in a first direction (e.g. S) to a filament or a cord, immediately followed by the same number of twist in an opposite direction (e.g. Z). The effect on the number of applied torsions is zero, but the false twister has an effect on the number of residual torsions.

According to a fourth aspect of the present invention, there is provided a method of manufacturing an m+n cord according to the first aspect of the invention.

This method comprises the following steps:

i. unwinding core steel filaments from one or more supply spools;
ii. guiding the unwound core steel filaments to a double-twister which is rotating in a double-twisting direction;
iii. applying a first twist in a first direction to the core steel filaments;
iv. unwinding sheath steel filaments from one or more supply spools inside the double-twister;
v. bringing the unwound sheath steel filaments together with the twisted core steel filaments at an assembly point inside the double-twister;
vi. applying a second twist in a second direction opposite to the first direction to the core steel filaments and the sheath steel filaments thereby untwisting the core steel filaments and twisting the sheath steel filaments and thus creating a twisted steel structure comprising the core steel filaments and the sheath steel filaments;
vii. guiding the twisted structure outside the double-twister to a first false twister rotating in a direction opposite to the double-twisting direction;
viii. thereafter guiding the twisted structure out of the first false twister to a second false twister rotating in a direction equal to the double-twisting direction thereby finalizing the m+n steel cord;
ix. winding the m+n steel cord on a cord spool.

DETAILED DESCRIPTION OF THE INVENTION

A steel cord according to the first aspect of the invention may be made in the following way.

Starting material may be a steel wire rod with a minimum carbon content of 0.65%, e.g. a minimum carbon content of 0.75%, a manganese content ranging from 0.40% to 0.70%, a silicon content ranging from 0.15% to 0.30%, a maximum sulfur content of 0.03%, a maximum phosphorus content of 0.30%, all percentages being percentages by weight. Micro-alloying elements such as chromium and copper, with percentages going from 0.10% up to 0.40% are not excluded, but are not needed.

The wire rod is firstly cleaned by mechanical descaling and/or by chemical pickling in a $H_2SO_4$ or HCl solution in order to remove the oxides present on the surface. The wire rod is then rinsed in water and is dried. The dried wire rod is then subjected to a first series of dry drawing operations in order to reduce the diameter until a first intermediate diameter.

At this first intermediate diameter $d_1$, e.g. at about 3.0 to 3.5 mm, the dry drawn steel wire is subjected to a first intermediate heat treatment, called patenting. Patenting means first austenitizing until a temperature of about 1000° C. followed by a transformation phase from austenite to pearlite at a temperature of about 600° C.-650° C. The steel wire is then ready for further mechanical deformation.

Thereafter the steel wire is further dry drawn from the first intermediate diameter $d_1$ until a second intermediate diameter $d_2$ in a second number of diameter reduction steps. The second diameter $d_2$ typically ranges from 1.0 mm to 2.5 mm.

At this second intermediate diameter $d_2$, the steel wire is subjected to a second patenting treatment, i.e. austenitizing again at a temperature of about 1000° C. and thereafter quenching at a temperature of 600° C. to 650° C. to allow for transformation to pearlite.

If the total reduction in the first and second dry drawing step is not too big a direct drawing operation can be done from wire rod till diameter $d_2$.

After this second patenting treatment the steel wire is usually provided with a brass coating: copper is plated on the steel wire and zinc is plated on the copper. A thermo-diffusion treatment is applied to form the brass coating.

The brass-coated steel wire is then subjected to a final series of cross-section reductions by means of wet drawing machines. The final product is a steel filament with a carbon content above 0.65 percent by weight (e.g. above 0.75 percent by weight), with a tensile strength typically above 2000 MPa (e.g. above 2500 MPa) and adapted for the reinforcement of elastomer products.

For the manufacture of a steel cord according to the present invention two different steel filament diameters are required, e.g. 0.16, 0.17 or 0.20 mm steel filaments and 0.22, 0.24 and 0.265 mm steel filaments.

Figure 1:
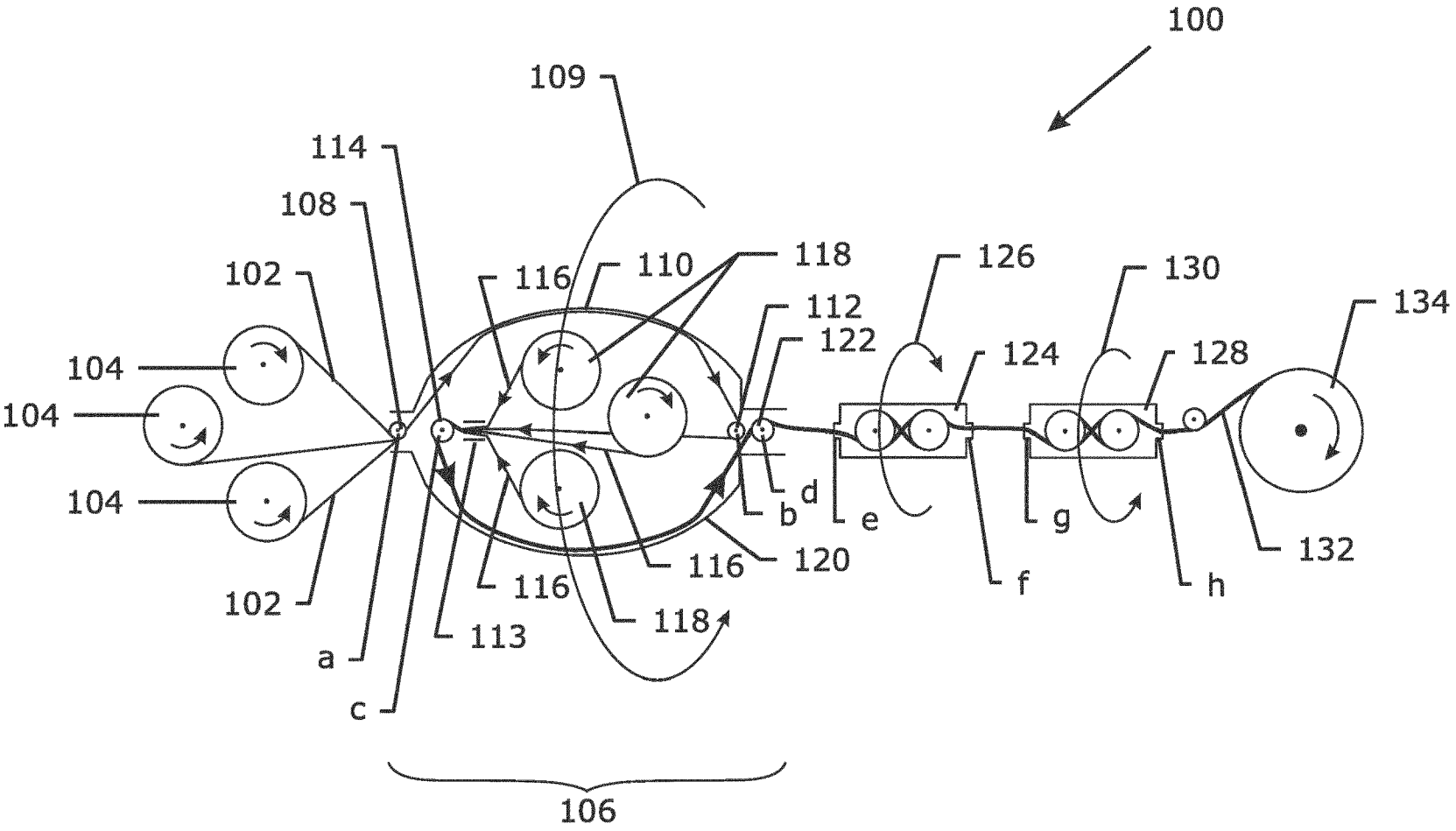
FIG. 1 is a schematic drawing of the equipment and process for making a steel cord according to the first aspect of the invention.

FIG. 1 gives an overview of an equipment 100 which may be used to make a steel cord according to the invention.

Starting from the left side of FIG. 1, three core steel filaments 102 with a filament diameter of $d_c$ are drawn from two supply spools 104 and guided to a double-twister or buncher 106. After passing a first stationary guiding pulley 108 the three core steel filaments 102 receive a first twist in the Z-direction due to the rotation direction 109 of a first flyer 110. Just before going over stationary reversing pulley 112, the three core steel filaments 102 receive a second twist in the Z-direction. The thus twisted core steel filaments 102 are then guided to an assembly point 113.

Three sheath steel filaments 116 with a filament diameter of $d_s$ are drawn from three supply spools 118 which are located in a stationary cradle (not shown) inside the double-twister 106. The three sheath steel filaments 116 are brought together with the three twisted core steel filaments 102 at the assembly point 113. At the level of the second stationary reversing pulley 114, both the core steel filaments 102 and the sheath steel filaments 116 receive a twist in the S-direction. This means that the three core steel filaments 102 are partially untwisted (from 2xZ-twists to one Z-twist) while the sheath steel filaments 116 are twisted. The assembly of two core steel filaments 102 and three sheath steel filaments 116 is guided over a second flyer 120 to a second stationary guiding pulley 122. At the level of the second stationary guiding pulley 122 the assembly receives a second twist in the S-direction. This means that the three core steel filaments 102 are now completely untwisted (from one Z-twist to zero) and that the three sheath steel filaments 116 have now been twisted twice in S-direction.

The resulting product leaving the double-twister 106 is a steel cord with a core group and a sheath group. The core group consists of three untwisted core steel filaments 102. The sheath group has three S-twisted sheath steel filaments 116. The sheath group is twisted in S-direction around the core group. This is a complete steel cord but not yet with all the features according to the invention.

The steel cord leaves the double-twister 106 and is led through a first false twister 124 which rotates in a direction 126 opposite to the rotation direction of the double-twister 106. The effect of this first false twister 124 will be explained with reference to FIG. 2*a* and FIG. 2*b*.

Subsequently the steel cord is also led to a second false twister 128 which rotates in a direction 130 opposite to the rotation direction of the first double-twister 124. The effect of this second false twister 128 will be explained with reference to FIG. 2*b*.

Finally a steel cord 132 possessing all the features of a steel cord according to the invention leaves the second false twister 128 and is wound upon a cord spool 134.

FIG. 1 also shows various positions a-b-c-d-e-f-g-h along the path followed by either the core steel filaments 102 and the sheath steel filaments 116 or both.

Figure 2A:
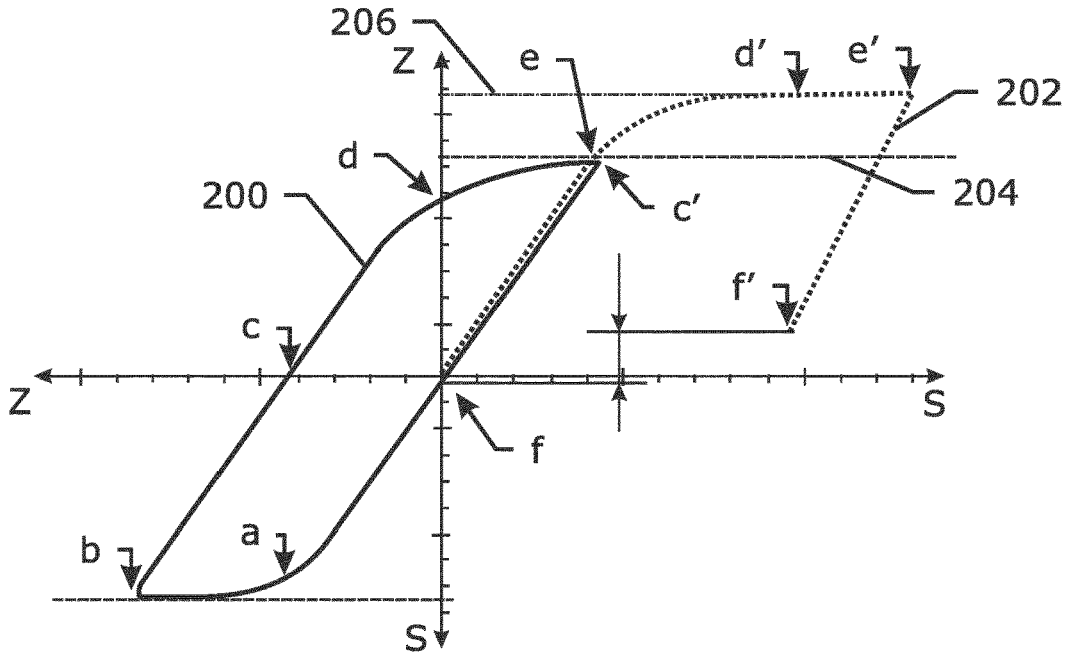
FIG. 2*a* shows torsion diagrams of a core steel filament and a sheath steel filament in a double twister followed by a single false twister.
Figure 2B:
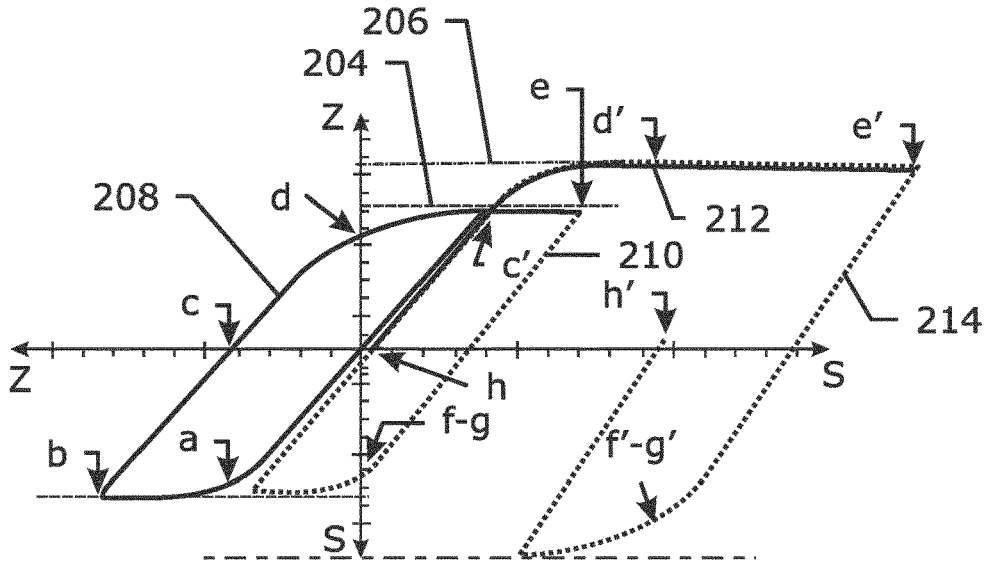
FIG. 2*b* shows torsion diagrams of a core steel filament and a sheath steel filament in a double twister followed by a double false twister.

FIG. 2*a* and FIG. 2*b* show torsion diagrams with mention of:

a-b-c-d-e-f-g-h: this corresponds each time with the torsion level of a core steel filament at the various positions a-b-c-d-e-f-g-h in FIG. 1;

a'-b'-c'-d'-e'-f'-g'-h': this corresponds each time with the torsion level of a sheath steel filament at the various positions a-b-c-d-e-f-g-h in FIG. 1.

FIG. 2*a* shows the torsion curve 200 of a core steel filament 102 being double-twisted and going through a single false twister 124 and the torsion curve 202 of sheath steel filament 116 being double-twisted and going through a single false twister 124.

The abscissa shows the applied torsions (number of revolutions per meter): S in the right direction, Z in the left direction.

The ordinate shows the residual torsions (number of revolutions per meter): Z in direction upwards, S in direction downwards.

Dash line 204 shows the torsion saturation level (number of revolutions per meter) of a core steel filament 102.

Dot and dash line 206 shows the torsion saturation level (number of revolutions per meter) of a sheath steel filament 116.

The torsion saturation level 204 of a core steel filament is lower than the torsion saturation level 206 of a sheath steel filament, since the core steel filament is thicker and reaches quicker the plastic deformation zone.

Still referring to FIG. 2*a*, and following torsion curve 200, a core steel filament 102 receives a first Z-twist at position a and a second Z-twist at position b. At position c the core steel filament 102 is partially untwisted because of a first S-twist. At position d, the core steel filament leaves the double-twister untwisted, i.e. with zero applied twists, because of a second S-twist. The core steel filament 102 is then sent to a false twister 124, where it receives first twists in S-direction—point e—and immediately thereafter twists in Z-direction to arrive at point f, with zero applied twists but with +3 residual revolutions per meter.

Still referring only to FIG. 2*a*, and following torsion curve 202, sheath steel filament 116 receives a first S-twist at c' and a second S-twist at d' when leaving the double-twister 106. Sheath steel filament 116 is then guided through false twister 124 where it receives first additional twists in S-direction—point e'—and immediately thereafter twists in Z-direction to arrive at point f', with a number of applied torsions corresponding to the desire lay length or cord twisting step and with −4.5 residual revolutions per meter.

With one false twister 124, the difference in residual torsions between a core steel filament 102 and a sheath steel filament 116 is 7.5 residual revolutions per meter.

This high difference in residual torsions per meter causes instability in the steel cord and requires a high deformation degree of the core steel filaments in order to anchor the steel cord in a rubber ply and to prevent tip rise of a rubber ply reinforced with this steel cord.

The improvement of the invention is explained with reference to FIG. 2*b*.

Curve 208-210 is the torsion curve of a core steel filament 102. Part 208 is the part with only one false twister 124, the dash part 210 is the part with an additional second false twister 128.

Core steel filament 102 receives a first Z-twist at position a and a second Z-twist at position b. At position c the core steel filament 102 is partially untwisted because of a first S-twist. At position d, the core steel filament leaves the double-twister untwisted, i.e. with zero applied twists, because of a second S-twist. The core steel filament 102 is then sent to a first false twister 124, where it receives first twists in S-direction—point e—and immediately thereafter a first series of twists in Z-direction because of first false twister 124 and a second series of twists in Z-direction because of second false twister 128—points f-g. Finally the second series of twists in Z-direction are compensated by twists in S-direction (action of second false twister 128) to arrive at point h with zero applied twists and—only −+1.8 residual revolutions per meter.

Curve 212-214 is the torsion curve of a sheath steel filament 116. Part 212 is the part with only one false twister 124, the dash part 214 is the part with an additional second false twister 128.

Sheath steel filament 116 receives a first S-twist at c' and a second S-twist at d' when leaving the double-twister 106. Sheath steel filament 116 is then guided to false twister 124 where it receives first additional twists in S-direction—point e'. Thereafter, sheath steel filament 116 receives a first series of Z-twists (action of first false twister 124) and a second series of Z-twists (action of second false twister 128)—points f'-g'. Finally the second series of Z-twists are compensated by a series of S-twists (action of second false twister 128) to arrive at point h', with a number of applied twists corresponding to the desired lay length or cord twisting step and with −2.5 residual revolutions per meter.

The number of residual torsions is determined per group, i.e. the number of residual torsions is determined for the core group as a whole and—separately—for the sheath group as a whole.

To determine the number of residual torsions per group a 4 meter length steel cord sample is taken. All residual cord torsions are first released. This 4 meter sample is fixed between two clamps which have an interdistance of 100 cm. The clamps have a rubber path in contact with the steel cord to avoid damage to the steel cord.

The purpose is to determine the number of residual torsions over this 100 cm length.

Outside the clamps, the steel cord is cut but leaving a length of about 10 cm. At one end, outside the clamps, the steel cord is plastically bent so that a length of about 5 cm points vertically upwards. The number of rotations of this bent part will indicate the number of residual torsions per meter.

For the determination of the residual torsions of the core group, one end of the steel cord is unclamped. The sheath steel filaments are unravelled by means of a gripper until past the clamp, while the bent part of the core group is kept vertical. Thereafter the core group is clamped again and the sheath steel filaments are unravelled until the second clamp. Now one is ready to determine the residual torsions in revolutions per meter of the core group: the first clamp is released again while holding the bent part of the core group vertical and thereafter the bent part is released and its number of rotations is counted.

For the determination of the residual torsions of the sheath group, one end of the steel cord is unclamped. The sheath steel filaments are unravelled by means of a gripper not only until past the first clamp but until the second clamp, while the gripper is kept horizontal so that the bent part of the sheath steel filaments is also kept stable. Once the unravelling has been done until the second clamp, one is ready to determine the residual torsions of the sheath group in revolutions per meter: the gripper releases the sheath group and the number of rotations of the bent part of the sheath group is counted.

With two false twisters 124, 128 the difference in residual torsions between the core group and the sheath group has been reduced to 4.3 residual revolutions per meter. This is a much more stable cord without flare and causing no tip rise in a rubber ply without having to deform the core steel filaments heavily.

Figure 3:
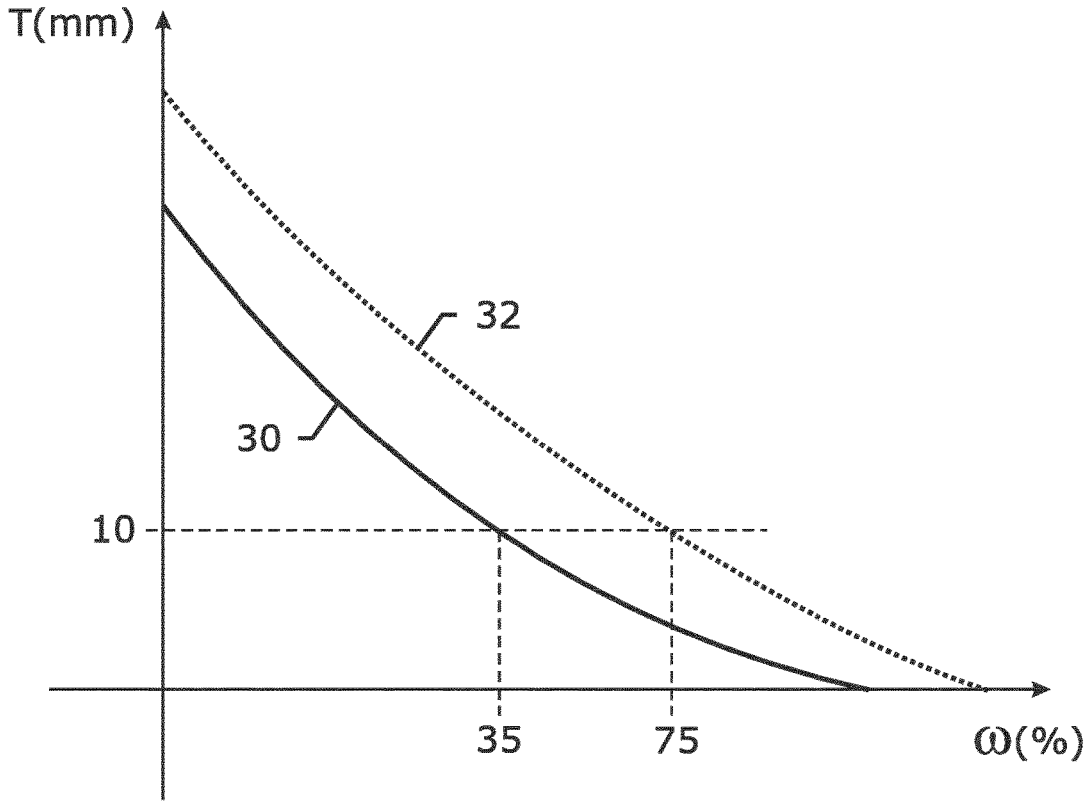
FIG. 3 illustrates the influence of a double false twister on tip rise of a rubber ply.

FIG. 3 illustrates the influence of a double false twister on tip rise of a rubber ply. The abscissa axis gives the rotation speed ω of the second false twister 128 in percentage. The ordinate gives the tip rise T of a rubber ply reinforced with steel cords in millimetre. Curve 30 is for a wave height $h_c$ of the core steel filaments of $2.7xd_c$ while curve 32 is for a wave height $h_c$ of the core steel filaments of $1.6xd_c$.

As a matter of example, the tip rise T can be limited to 10 mm with a wave height $h_c$ of $2.7xd_c$ and a rotation speed ω of 35%. Increasing the rotation speed ω to 75% may reduce the wave height $h_c$ to 0.36 mm without increase of tip rise T.

FIG. 4*a*, FIG. 4*b*, FIG. 4*c* and FIG. 4*d* show various cross-sections of a steel cord 132 according to the first aspect of the invention.

Figure 4A:
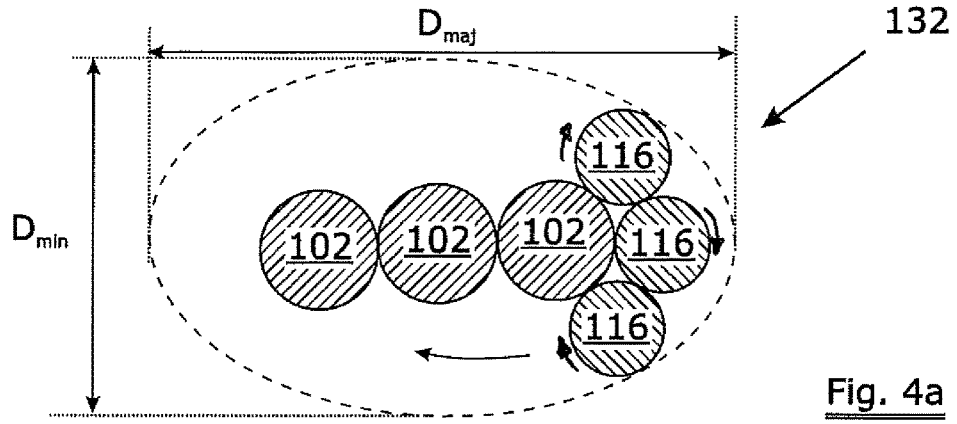
FIG. 4*a*, FIG. 4*b*, FIG. 4*c* and FIG. 4*d* show cross-sections of a steel cord according to the first aspect of the invention.

Referring to FIG. 4*a*, steel cord 132 has a core group of three parallel core steel filaments 102 each with a filament diameter $d_c$. Steel cord 132 further has a sheath group of three twisted sheath steel filaments 116 each with a filament diameter $d_s$. Due to the fact that the three core steel filaments 102 are untwisted the cord 132 has an oval cross-section with a major axis or major diameter $D_{maj}$ and a minor axis or minor diameter $D_{min}$.

Figure 4B:
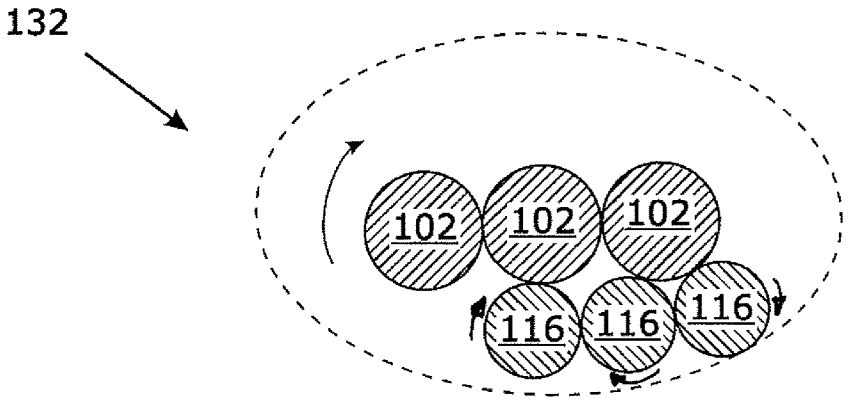

FIG. 4*b* is a cross-section of the same steel cord 132 but at a distance of ¼ of a cord twisting step from the situation of FIG. 4*a*.

Figure 4C:
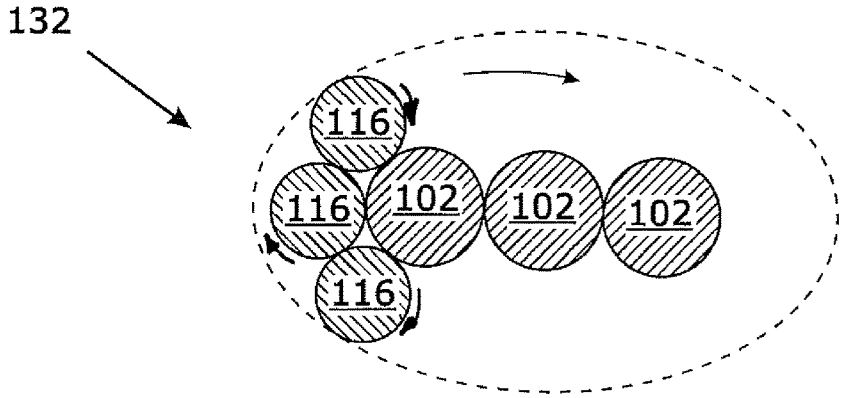

FIG. 4*c* is a cross-section of the same steel cord 132 but at a distance of ½ of a cord twisting step from the situation of FIG. 4*a*.

Figure 4D:
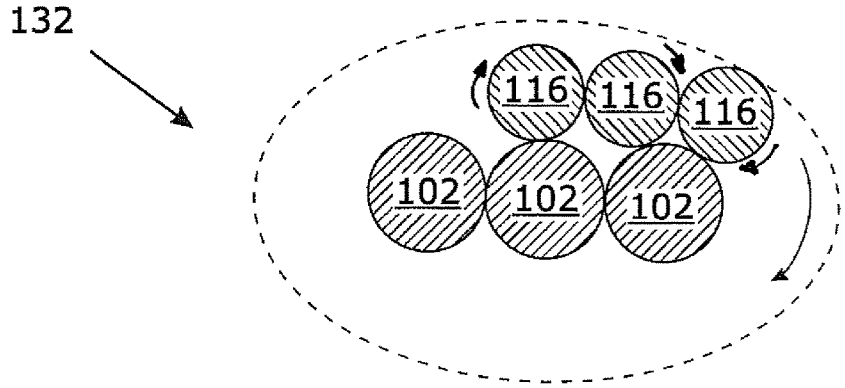

FIG. 4*d* is a cross-section of the same steel cord 132 but at a distance of ¾ of a cord twisting step from the situation of FIG. 4*a*.

As a result of the double-twisting process in the double-twister 106, the sheath steel filaments 116 are not only twisted around each other but each sheath steel filament 116, as such, also shows a twist in the same direction and to the same degree around its own longitudinal axis.

Figure 5:
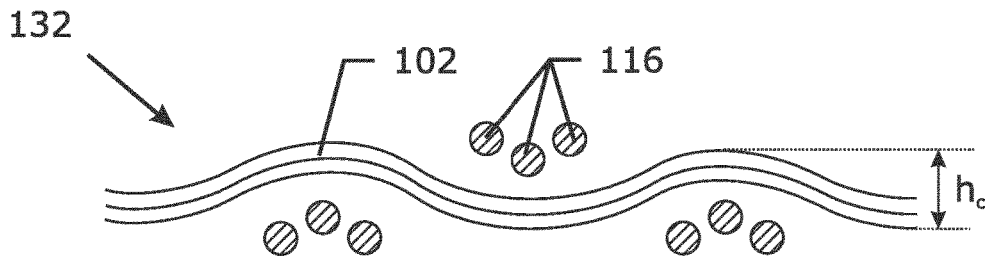
FIG. 5 shows a longitudinal view of a steel cord according to a first aspect of the invention.

FIG. 5 is a longitudinal view of a steel cord 132 according to the invention. The wave height $h_c$ of the core steel filaments 102 is the amplitude formed by the wave of the core steel filaments 102 including the diameter of the core steel filament(s).

As has been explained hereabove, thanks to the action of the double false twister 128, the difference in residual torsions between the core steel filaments 102 and the sheath steel filaments 116 can be reduced. As a result of this reduction the wave height $h_c$ can also be reduced leading to a more stable and closed structure and without causing flare or tip rise.

Figure 6:
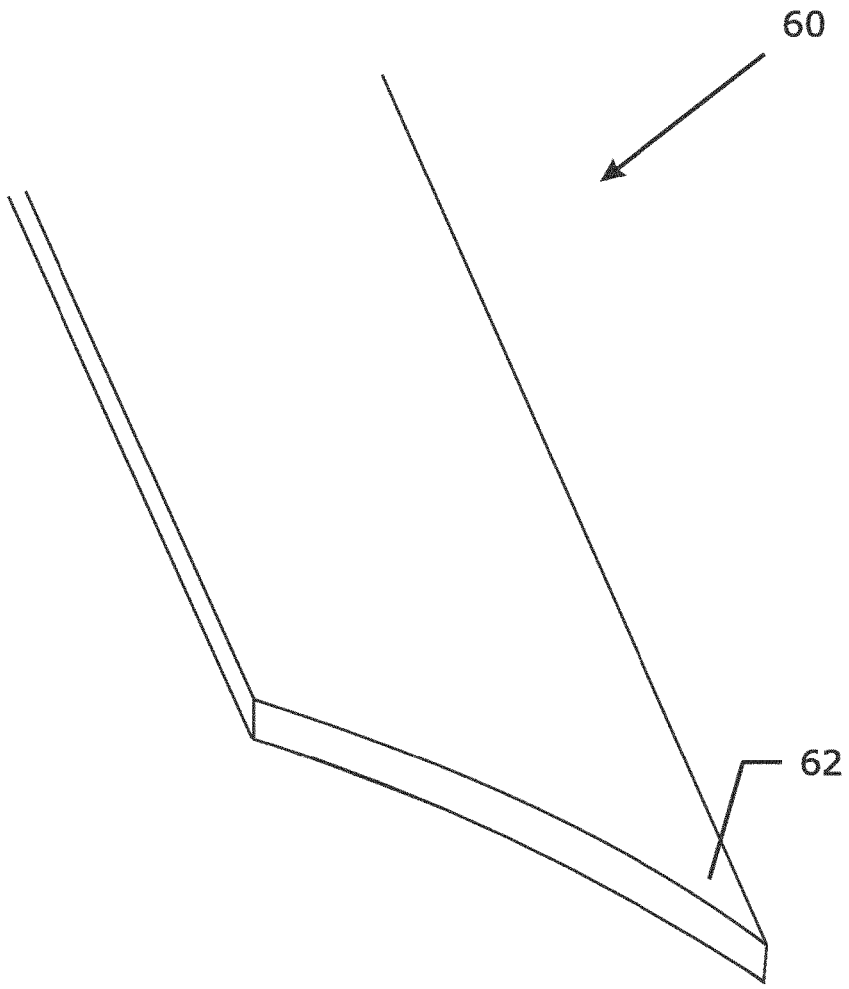
FIG. 6 shows a rubber ply.

FIG. 6 shows a rubber ply 60 which has been reinforced with steel cords 132 and which has been cut to become part of a breaker or belt ply in a tyre. The rubber ply 60 does not exhibit tip rise, i.e. edge 62 is not lifted.

Comparison of Prior Art Cords Versus Invention Cords

| Cord | 2 × 0.24 + 1 × 0.20 HT | | 4 × 0.20 + 6 × 0.16 ST | | 2 × 0.22 + 3 × 0.16 ST | | 3 × 0.265 + 3 × 0.17 UT | |
|---|---|---|---|---|---|---|---|---|
| m | 2 | | 4 | | 2 | | 3 | |
| n | 1 | | 6 | | 3 | | 3 | |
| dc (mm) | 0.24 | | 0.2 | | 0.22 | | 0.265 | |
| ds (mm) | 0.2 | | 0.16 | | 0.16 | | 0.17 | |
| dc/ds | 1.2 | | 1.3 | | 1.4 | | 1.6 | |
| Rm core group (MPa) | 3320 | | 3580 | | 3540 | | 3870 | |
| Rm sheath group (MPa) | 3400 | | 3660 | | 3660 | | 4060 | |
| SLc (revolutions/m) | 38.4 | | 49.7 | | 44.7 | | 40.6 | |
| SLs (revolutions/m) | 47.2 | | 63.5 | | 63.5 | | 66.3 | |
| \| SLc − SLs \| | 8.8 | | 13.8 | | 18.8 | | 25.7 | |
| process | No DFT | DFT | No DFT | DFT | No DFT | DFT | No DFT | DFT |
| RTc (revolutions/m) | 1.4 | 0.7 | 4.3 | 2.1 | 4.1 | 2.1 | 2.7 | 1.3 |
| RTs (revolutions/m) | −5.7 | −2.8 | −6.9 | −3.3 | −9.7 | −4.9 | −15.9 | −7.7 |
| \| RTc − RTs \| | 7.0 | 3.5 | 11.2 | 5.4 | 13.8 | 7.0 | 18.6 | 9.0 |
| ratio p | 0.8 | 0.4 | 0.81 | 0.39 | 0.73 | 0.37 | 0.72 | 0.35 |

m: number of filaments in core group n: number of filaments in sheath group dc: diameter of core steel filaments ds: diameter of sheath steel filaments Rm: tensile strength of steel filaments No DFT: prior art process without double false twister DFT: invention process with double false twister Factor φ: depends upon tensile strength level Ratio ρ: ratio of difference in torsion gap measured to difference in sauration level SLc: saturation level core group SLs: saturation level sheath group RTc: Residual torsions of core group RTs: residual torsions of sheath group HT: high-tensile strength ST: super-high-tensile strength UT: ultra-high-tensile strength A high-tensile (HT) strength means a steel filament with a tensile strength between 3800-2000×d MPa and 4000-2000×d MPa, where d is the filament diameter and is expressed in mm.

A super-high-tensile (ST) strength means a steel filament with a tensile strength between 4000-2000×d MPa and 4400-2000×d MPa, where d is the filament diameter and is expressed in mm.

An ultra-high-tensile (UT) strength means a steel filament with a tensile strength above 4400-2000×d MPa.

LIST OF REFERENCE NUMBERS

100 equipment to make a steel cord according to the invention
102 core steel filament
104 supply spool of core steel filament
106 double-twister
108 stationary guiding pulley
109 rotating direction of double-twister
110 first flyer
112 first stationary reversing pulley
113 assembly point
114 second stationary reversing pulley
116 sheath steel filament
118 supply spool of sheath steel filament
120 second flyer
122 second stationary guiding pulley
124 first false twister
126 direction of rotation of first false twister
128 second false twister
130 direction of rotation of second false twister
132 steel cord
134 cord spool for winding steel cord
200 torsion curve of core steel filament with single false twister
202 torsion curve of sheath steel filament with single false twister
204 torsion saturation level of a sheath steel filament
208-210 torsion curve of core steel filament with double false twister
212-214 torsion curve of sheath steel filament with double false twister
30 curve of tip rise versus rotation speed of second false twister
32 curve of tip rise versus rotation speed of second false twister
60 rubber ply
62 edge of rubber ply
a position at first stationary guiding pulley 108
b position at first stationary reversing pulley 112
c position at second stationary reversing pulley 114
d position at second stationary guiding pulley 120
e position before entry into first false twister 124
f position after leaving first false twister 124
g position before entry into second false twister 128
h position after leaving second false twister 128

The invention claimed is:

1. A steel cord adapted to reinforce a breaker or belt ply in a rubber tire, said steel cord comprising a core group and a sheath group, said core group consisting of two to four core steel filaments with a first diameter $d_c$, said sheath group consisting of one to six sheath steel filaments with a second diameter $d_s$, the ratio $d_c/d_s$ of said first diameter $d_c$ to said second diameter $d_s$ ranging from 1.10 to 1.70, said core steel filaments being untwisted or having a twist pitch of greater than 300 mm, said sheath group being twisted around said core group with a cord twisting step in a cord twisting direction, wherein the ratio ρ of the absolute value of the difference in residual torsions between the core group and the sheath group to the absolute value of the difference in saturation level between the core group and the sheath group ranges from 0.15 to 0.65.

2. The steel cord according to claim 1, wherein the amount of residual torsions of said core group is different from the amount of residual torsions of said sheath group.

3. The steel cord according to claim 1, wherein each sheath filament is twisted by itself.

4. The steel cord according to claim 1, wherein said one to six sheath steel filaments are twisted around each other with said cord twisting step and in said cord twisting direction.

5. The steel cord according to claim 1, wherein each of said core steel filaments has a wave height $h_c$ ranging from $2.2xd_c$ to $2.7xd_c$.

6. The steel cord according to claim 1, wherein each of said sheath filaments has a wave height $h_s$ ranging from $2.2xd_s$ to $3.9xd_s$.

7. The steel cord according to claim 1, wherein said steel cord has no flare.

8. The steel cord according to claim 1, wherein said steel cord has a tensile strength exceeding 2500 MPa.

9. A rubber ply comprising a plurality of steel cords according to claim 1, said steel cords being arranged in parallel next to each other, said rubber ply having a tip rise being lower than 30 mm.

10. The steel cord according to claim 1, wherein the ratio ρ of the absolute value of the difference in residual torsions ranges from 0.25 to 0.50.

11. The steel cord according to claim 1, wherein said steel cord has a tensile strength exceeding 2700 MPa.

* * * * *